United States Patent [19]

Benway

[11] Patent Number: 4,622,490

[45] Date of Patent: Nov. 11, 1986

[54] CATHODE-RAY TUBE WITH AN INTERNAL MAGNETIC SHIELD

[75] Inventor: Robert E. Benway, Marion, Ind.

[73] Assignee: RCA Corporation, Princeton, N.J.

[21] Appl. No.: 706,407

[22] Filed: Feb. 28, 1985

[51] Int. Cl.[4] ..... H01J 29/06; H01J 29/94

[52] U.S. Cl. ..... 313/402; 313/407; 313/481

[58] Field of Search ..... 313/402, 407, 481, 479

[56] References Cited

U.S. PATENT DOCUMENTS

| | | | |
|---|---|---|---|
| 3,802,757 | 4/1974 | Benda et al. | 313/481 X |
| 4,019,085 | 4/1977 | Sakata | 313/479 X |
| 4,198,587 | 4/1980 | Verhoeven et al. | 313/402 |
| 4,506,188 | 3/1985 | Puhak | 313/407 X |

FOREIGN PATENT DOCUMENTS

| | | | |
|---|---|---|---|
| 0000858 | 1/1979 | Japan | 313/479 |
| 1226728 | 3/1971 | United Kingdom | 313/481 |

*Primary Examiner*—Palmer C. DeMeo

*Attorney, Agent, or Firm*—E. M. Whitacre; D. H. Irlbeck; T. H. Magee

[57] ABSTRACT

A cathode-ray tube has a rectangular faceplate panel sealed to a funnel thereof along an edge of a sidewall of the panel, and has an internal magnetic shield disposed therein proximate an inner surface of the sidewall and extending backward along an inner surface of the funnel. The magnetic shield has at least one opening disposed in at least one corner thereof for allowing dispersal of getter material therethrough and onto the inner surfaces of the sidewall and the funnel adjacent the edge.

7 Claims, 3 Drawing Figures

CATHODE-RAY TUBE WITH AN INTERNAL MAGNETIC SHIELD

BACKGROUND OF THE INVENTION

This invention pertains to a cathode-ray tube with an improved internal magnetic shield.

A color cathode-ray tube typically has an internal magnetic shield to reduce the influence of magnetic fields on electron beam trajectories as a cathodoluminescent screen of the tube is scanned. The shield is usually made of 0.10 to 0.18 mm thick cold-rolled steel and is fastened to a shadow-mask frame so that the shield and frame are magnetically coupled. The frame is supported by mounting studs that extend inwardly from a glass rectangular faceplate panel of the tube. During tube fabrication, the magnetic shield is fastened to the frame prior to the step of frit sealing an edge of the faceplate panel to a glass funnel of the cathode-ray tube. The magnetic shield is designed to fit into the funnel and be as close to the funnel wall as possible so that it will not provide a surface from which overscan electrons will be scattered back onto the screen. The magnetic shield should not touch the funnel of the cathode-ray tube to avoid any friction between the shield and a conductive anode coating on the inner surface of the glass funnel. Such friction may occur during assembly of the funnel to the faceplate panel or during uneven expansion at a subsequent heating step, and would create loose particles within the tube which are undesirable. The conductive anode coating is generally applied so that it extends to within a predetermined distance from the glass frit applied between the funnel and the panel, in order to avoid possible contamination thereof during the frit sealing step.

The cathodoluminescent screen of the cathode-ray tube generally comprises a thin coating of aluminum on the back surface of a phosphor screen. This aluminized coating is applied to the inner surface of the glass faceplate panel so that it extends to within a predetermined distance from the glass frit, also to avoid possible contamination of the glass frit. The aluminum coating is connected to the conductive anode coating inside the funnel by means of spring attachments connected to the frame after the magnetic shield is fastened thereto. As a result, the full anode voltage is applied to the phosphor screen. However, the inner glass surfaces of the funnel and the panel adjacent the edge thereof are left uncoated.

During warmup of the color cathode-ray tube in a television receiver, bright areas have been observed in corners thereof which remain visible throughout the warmup period, particularly in the upper two corners. It was observed that the placement of mounting hardware or grounding straps enhances the intensity of the bright areas, and that the brightness effect is more pronounced with an electron beam overscan greater than 5 percent, particularly at 10 percent overscan which is common in most tubes. The bright areas are a time oriented effect which disappear after a few seconds or minutes after the warmup period. The problem exists on all tube types utilizing an internal magnetic shield. However, the effect of this problem was heightened after a modification was made to the design of an internal magnetic shield to provide more clearance between the shield and the funnel. The diagonal contours of this internal magnetic shield were flatened to provide more clearance from the shield to the conductive anode coating on the inside surface of the funnel. The present invention provides for an apertured internal magnetic shield which eliminates the bright areas noticed in the corners of the cathode-ray tube during warmup.

SUMMARY OF THE INVENTION

The present invention comprises a cathode-ray tube, including a rectangular faceplate panel sealed to a funnel thereof along an edge of the panel, wherein an internal magnetic shield has aperture means disposed in at least one corner thereof for allowing dispersal of getter material therethrough and onto inner corner surfaces of the tube adjacent the edge.

DETAILED DESCRIPTION OF THE PREFERRED EMBODIMENT

Figure 1:
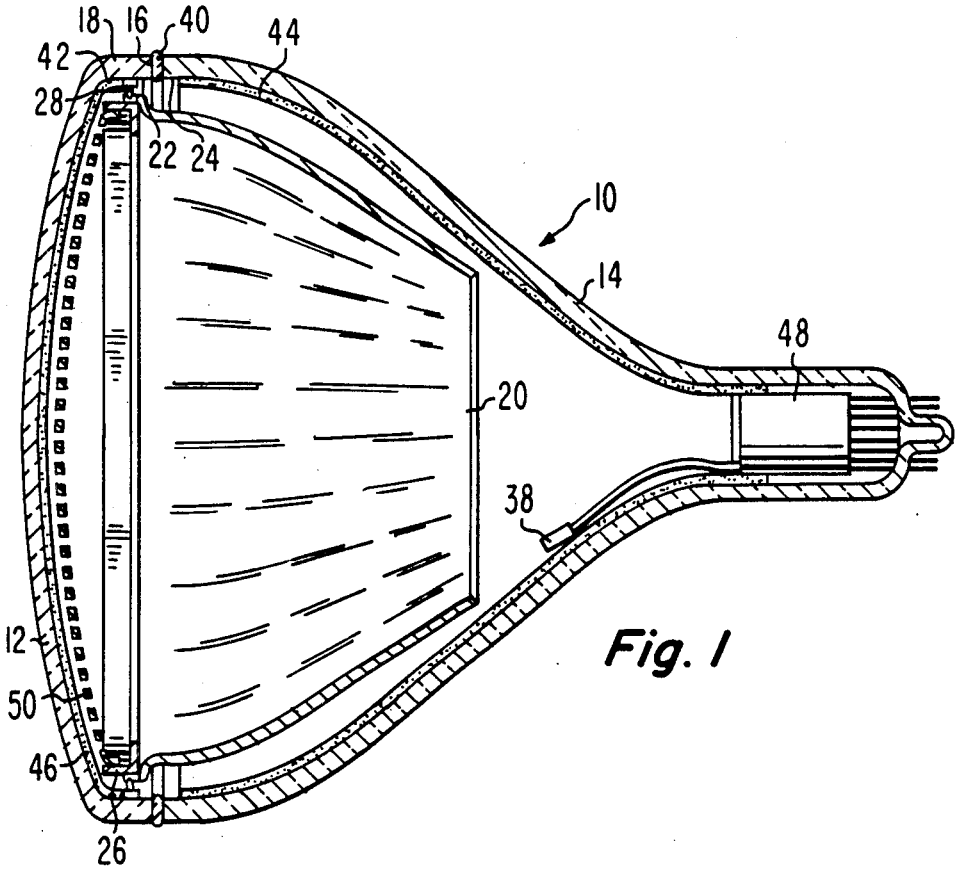
FIG. 1 is a cross-sectional view illustrating a cathode-ray tube having an internal magnetic shield disposed therein.
Figure 2:
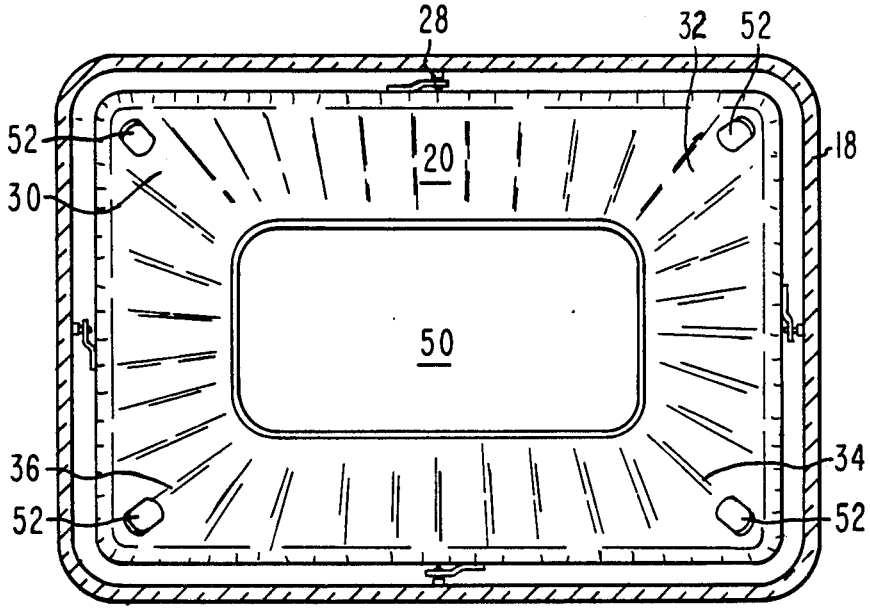
FIG. 2 is an elevation view of the present novel internal magnetic shield within a cathode-ray tube having the funnel removed.

FIG. 1 of the drawings shows a cathode-ray tube 10 having a faceplate panel 12 sealed to a funnel 14 thereof along an edge 16 of a sidewall 18 of the panel 12. The tube 10 has an internal magnetic shield 20 disposed therein proximate an inner surface 22 of the sidewall 18 adjacent the edge 16 thereof and extending backward along an inner surface 24 of the funnel 14. The magnetic shield 20 is fastened to a shadow-mask frame 26 which is supported by mounting studs 28 that extend inwardly from the faceplate panel 12. Since the sidewall 18 of the faceplate panel 12 is generally rectangularly shaped, as shown in FIG. 2, the typical internal magnetic shield 20 has four corners 30, 32, 34 and 36.

The cathode-ray tube 10 also includes means 38 disposed therein for depositing getter material within the tube 10. A getter material has the property of sorbing gases remaining after exhausting the tube 10, or those later released by the walls of the tube 10, or by structural components therein. The active getter material, typically a barium composition, is evaporated from its container within the tube 10 by quick heating, or flashing, and then dispersed onto the inner surface of the tube 10 in the form of a thin film.

The faceplate panel 12 is sealed to the funnel 14 of the cathode-ray tube 10 by means of a glass frit 40 disposed along the edge 16 of the sidewall 18. The inner surfaces 22 and 24 of the side wall 18 and funnel 14 have, respectively, first and second conductive coatings 42 and 44 thereon extending to within a predetermined distance from the glass frit 40. The first conductive coating 42 is part of a cathodoluminescent screen 46 formed on the inside surface of the faceplate panel 12, and comprises a thin coating of aluminum on the back surface of a phosphor screen. This aluminized screen is applied to the inner surface 22 after a screening process, and extends to between about 0.5 centimeters and about 2 centimeters from the glass frit 40 in order to avoid possible contamination of the frit 40 when it is subsequently applied during the panel-to-funnel sealing step. The second conductive coating 44 comprises an internal graphite coating which extends along the inner surface 24 of the funnel 14 to between about 0.5 centimeters and about 2 centimeters from the glass frit 40, thus, avoiding possible contamination thereof. This second coating 44 serves as the positive anode for the tube 10.

During operation of the cathode-ray tube 10, an electron gun 48 emits beams of electrons which are accelerated to the cathodoluminescent screen 46, through a multi-apertured shadow mask 50, by positive anode voltage. The electron beams are defected by a magnetic yoke (not shown) so as to scan the beams in a rectangular raster over the screen 46. The electron beams overscan the screen 46 typically by 10 percent, causing the beams to pass between the internal magnetic shield 20 and the inner surface 24 of the funnel 14. As mentioned above, the appearance of bright areas in the corners of the tube 10 was more pronounced with electron beam overscan greater than 5 percent.

It is hypothesised that the undesirable bright areas, observed primarily in the corners of the cathode-ray tube 10 during warmup, are attributable to a glass-charging effect which causes the overscanned electron beams to be bent or deflected away from the inner surface 22 of the sidewall, around the ends of the shadow mask 50 and onto the edges of the cathodoluminescent screen 46. This glass-charging effect is created by electrons from the electron beams which accumulate on the uncoated inner surfaces 22 and 24 of the glass sidewall 18 and funnel 14. The uncoated glass surfaces do not provide an effective conductive path which allows the negative charge to readily dissipate. During the warmup period, this charge eventually leaks off as the high anode voltage takes affect and creates a sufficient leakage path across the uncoated glass surfaces.

The glass-charging effect occurs primarily at the corners of the cathode-ray tube 10 due to the fact that there is more electron beam overscan and, thus, more electrons available for charging. Also, during the screening process in the factory, the first conductive coating 42, as applied, does not have an even border around the inner surface 22 of the sidewall 18, and may leave more uncoated surface area in the corners of the sidewall 18. In addition, the accumulated electron charge has a greater effect on the electron beams in the corners of the tube 10, as a result of an inherent geometrical "corner effect" which concentrates a greater electric field at the corners. It was also observed that the placement of mounting hardware or grounding straps, which are typically placed in this area of the tube 10 near the glass frit 40, enhances the charging effect in that area by adding more capacitance between the inside and the outside of the tube 10.

In order to eliminate this glass-charging effect, aperture means 52 are disposed in the internal magnetic shield 20 for allowing dispersal of the getter material therethrough and onto the inner surfaces 22 and 24 of the sidewall 18 and funnel 14 adjacent the edge 16. Preferably, the aperture means 52 is sufficient in size to allow dispersal of the getter material over the glass firt 40 and onto both the first and the second conductive coatings 42 and 44. The aperture means 52 is centered in one or more corners 30, 32, 34 and 36 of the magnetic shield 20. In the present embodiment shown in FIG. 2, the aperture means 52 comprises a single opening positioned adjacent the glass frit 40 in each of the four corners 30, 32, 34 and 36. The aperture means 52 may also comprise a plurality of openings positioned adjacent the glass frit 40 at one or more corners 30 ,32, 34 and 36 of the shield 20. However, in order not to reduce the magnetic shielding effect of the shield 20, the total area of the aperture means 52 should be less than twenty percent of the peripheral surface area of the shield adjacent the inner surfaces 22 and 24.

Figure 3:
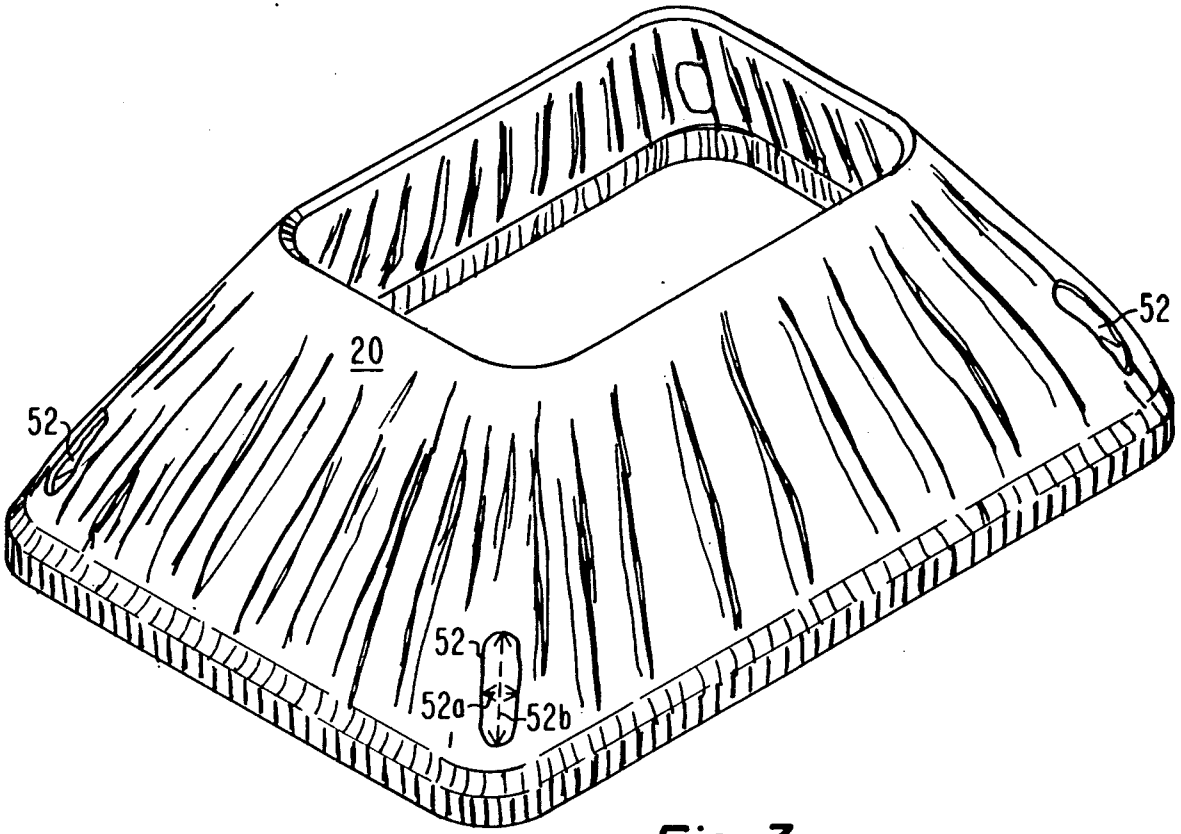
FIG. 3 is a perspective view of the present internal magnetic shield illustrating the novel aperture means disposed in corners thereof.

Each of the openings in the present embodiment is ellipsoidally shaped with a minor axis 52*a* oriented parallel to the geometric plane of the edge 16 of the sidewall 18, and a major axis 52*b* centered along the shield corner and intersecting the plane of the edge 16, as shown in FIG. 3. Preferably, the length of the minor axis 52*a* is about two centimeters and the length of the major axis 52*b* is about five centimeters. Such openings do not affect the magnetic properties of the shield 20 and the subsequent register of the electron beams. Preferably, the openings are punched out after forming the magnetic shield 20. A preblanked opening stage may also be utilized to place the openings therein before forming the shield 20, but the location and size of the openings may change during the process of forming the shield 20.

The present novel aperture means 52 allows effective distribution of the getter material into the corners of the cathode-ray tube 10 where the glass-charging effect is very noticeable. The top two corners of the tube 10, corresponding to the upper pair of corners 30 and 32 in the internal magnetic shield 20, are the most troublesome because they are shielded from the depositing getter material. The getter deposting means 38 is generally positioned closer to the lower pair of corners 34 and 36, as shown in FIG. 1, resulting in the fact that the internal magnetic shield 20 is disposed in the line-of-sight of the depositing getter material and, thereby, effectively blocks the dispersing getter material from being distributed into the top two corners of the tube 10 during a getter flashing step. The aperture means 52, particularly the openings disposed in the upper pair of corners 30 and 32, allows the getter material to be deposited over the glass frit 40 and onto the uncoated portions of the inner surfaces 22 and 24 at the troublesome corner locations.

The significance of allowing getter material to be deposited into the corners of the cathode-ray tube 10 is that the getter deposit provides an effective conductive path which allows the negative charge at the corners of the tube 10 to readily dissipate. Such a discharge path eliminates the bright areas noticed in the corners of the tube 10 during warmup by permitting a rapid leak-off of negative charge, thereby preventing the charge buildup which causes bending of the overscanned electron beams. These strategically positioned openings are able to effectively eliminate this glass-charging phenomena on all tube types which utilize an internal magnetic shield.

What is claimed is:

1. In a cathode-ray tube having a rectangular faceplate panel sealed to a funnel thereof along an edge of a sidewall of said panel, and having an internal magnetic shield with a plurality of corners disposed therein proximate an inner surface of said sidewall adjacent the edge thereof and extending backward along an inner surface of said funnel adjacent said edge, said tube including means disposed therein for depositing getter material within said tube, the improvement comprising said internal magnetic shield having aperture means disposed in at least one corner thereof for allowing dispersal of said getter material therethrough and onto the inner surfaces of said sidewall and said funnel adjacent said edge, the total area of said aperture means being less than twenty percent of the peripheral surface area of said shield adjacent said inner surfaces.

2. A cathode-ray tube as defined in claim 1 wherein a glass frit is disposed along the edge of said sidewall, the inner surfaces of said sidewall and said funnel have, respectively, first and second conductive coatings thereon extending to within a predetermined distance from said glass frit, and said aperture means is sufficient in size to allow dispersal of said getter material over said glass frit and onto both said first and said second coatings.

3. A cathode-ray tube as defined in claim 2 wherein said internal magnetic shield has four corners, and each of said corners has said aperture means centered therein.

4. A cathode-ray tube as defined in claim 3 wherein said depositing means is positioned closer to a lower pair of corners than an upper pair of corners, and wherein each corner of said upper pair of corners has said aperture means disposed therein.

5. A cathode-ray tube as defined in claim 3 wherein said aperture means comprises a single opening positioned adjacent said glass frit.

6. A cathode-ray tube as defined in claim 5 wherein said opening is ellipsoidally shaped with a minor axis oriented parallel to the geometric plane of said edge and a major axis intersecting the plane of said edge.

7. A cathode-ray tube as defined in claim 6 wherein said predetermined distance is between about 0.5 centimeter and about 2 centimeters, and wherein the length of said minor axis is about two centimeters and the length of said major axis is about five centimeters.

* * * * *